United States Patent [19]

Kenton

[11] 4,302,256

[45] Nov. 24, 1981

[54] METHOD OF IMPROVING MECHANICAL PROPERTIES OF ALLOY PARTS

[75] Inventor: Donald J. Kenton, Edmond, Okla.

[73] Assignee: Chromalloy American Corporation, Midwest City, Okla.

[21] Appl. No.: 94,909

[22] Filed: Nov. 16, 1979

[51] Int. Cl.[3] ..... C21D 1/78

[52] U.S. Cl. ..... 148/4; 148/131

[58] Field of Search ..... 148/4, 131, 32.5, 162, 148/133, 13, 160

[56] References Cited

U.S. PATENT DOCUMENTS

| | | | |
|---|---|---|---|
| 3,168,607 | 2/1965 | Greene | 148/131 |
| 3,496,624 | 2/1970 | Kerr et al. | 148/131 |
| 3,732,128 | 5/1973 | Statham | 148/131 |
| 3,758,347 | 9/1973 | Stalker | 148/131 |
| 4,021,910 | 5/1977 | Freeman, Jr. et al. | 148/131 |
| 4,125,417 | 11/1978 | Antony | 148/4 |

*Primary Examiner*—Peter K. Skiff

*Attorney, Agent, or Firm*—Hopgood, Calimafde, Kalil, Blaustein & Judlowe

[57] ABSTRACT

Age-hardenable alloy parts having melting points in excess of 1000° C., in particular high temperature superalloys, characterized by the presence of such structural defects as cast micropores, and/or grain boundary voids or internal microcracks resulting from high temperature service, are improved in mechanical properties by subjecting said parts to hot isostatic pressure in an autoclave at selected elevated solution temperatures in excess of 50% of the absolute melting point of the alloy and superatmospheric pressures sufficient to remove substantially said defects followed by rapidly cooling the parts in situ from the selected temperature while maintaining the parts under superatmospheric pressure in the autoclave.

14 Claims, 4 Drawing Figures

METHOD OF IMPROVING MECHANICAL PROPERTIES OF ALLOY PARTS

This invention relates to a method of upgrading the mechanical properties of age-hardenable alloys of melting points in excess of 1000° C. and, in particular, to a method of employing HIP processing in upgrading the mechanical properties of cast alloy parts, such as jet engine components, whether in the used or unused condition, for example, alloy parts made of iron-base, nickel-base, cobalt-base alloys, and also titanium-base alloys. The invention is particularly applicable in the treatment of cast age-hardenable superalloys.

BACKGROUND OF THE INVENTION

It is known to employ hot isostatic pressure processing techniques (HIP) for upgrading the mechanical properties of alloys, for example, cast alloys, characterized by the presence of micropores and/or other structural defects. According to U.S. Pat. No. 3,758,347, a metal casting of an alloy based on an element selected from the group consisting of Ni, Co, Fe, and Ti and having internal discontinuities, such as porosity, microfissures, cracks, and the like, can be improved by applying isostatic pressure to the casting at an elevated temperature less than that temperature which will cause substantial degradation of the mechanical properties of the alloy for a time sufficient to close the pores and effect diffusion bonding of the walls of the pores, fissures, etc. Superalloys are mentioned in particular, such as age-hardenable nickel-base superalloys designated by the trademarks René 80, René 100, etc. René 80 contains 0.17% C, 14% Cr, 5% Ti, 0.015% B, 3% Al, 4% W, 4% Mo, 9.5% Co, 0.03% Zr, and the balance nickel, while René 100 contains 0.17% C, 9.5% Cr, 4.2% Ti, 0.015% B, 5.5% Al, 3% Mo, 15% Co, 0.06% Zr, 1% V, and the balance nickel.

According to the patent, in the treatment of René 80 castings in an autoclave heated to 2225° F. (1218° C.) at a pressure of 10,000 psig, samples of the alloy were held for about 8 hours and then removed after cooling. The HIP treated samples were compared to samples not given the HIP treatment and following heat treatment. Both the HIP treated and untreated samples were subjected to a solution treatment at 2225° F. (1218° C.) for 2 hours in a vacuum, then inert gas quenched to room temperature followed by heating at 2000° F. (1093° C.) for 4 hours in vacuum and inert gas quenching to room temperature. Following the latter quench, the alloy samples were aged at 1925° F. (1052° C.) for 4 hours, furnace cooled to 1200° F. (649° C.) and held for 1 hour prior to air cooling to room temperature. Finally the two types of samples were heated at 1550° F. (843° C.) for 16 hours in Argon and then cooled to room temperature.

The alloy samples were then tested for stress-rupture at 1600° F. (871° C.) under a stress of 45,000 psi. The results showed that the untreated samples (2 tests) exhibited an average life of about 41.5 hours and an average percent elongation of about 2.5 hours.

The samples treated by HIP (6 samples) exhibited an average stress-rupture value of 141 hours and an average percent elongation of about 11.5%.

As will be apparent, the HIP treatment applied to the aforementioned nickel-base alloy markedly improved the stress-rupture properties.

Elimination of casting defects by using HIP is disclosed in a paper entitled "Elimination of Casting Defects Using HIP" by G. E. Wasielewski and N. R. Lindblad; Proceedings on The Second International Conference on Superalloys—Processing; Seven Springs, Pa., September 1972.

According to the aforementioned paper, stress-rupture properties and room temperature ductility of nickel-base superalloys, for example, alloys referred to by the designation IN-738, René 77, IN-792, etc., can be improved by means of the HIP processing technique at temperatures ranging from about 2000° F. (1093° C.) to 2200° F. (1204° C.) for 1 to 10 hours at pressures ranging from about 5,000 to 30,000 psi, a temperature of 2150° F. (1177° C.) to 2200° F. (1204° C.) being particularly preferred to provide 100% densification of the alloy part.

Similar improvements are indicated with HIP processing in a paper entitled "Improved Components Through Howmet's HIP Process", by T. H. Smith and L. Dardi; published in *Casting About*, Spring (April) 1974 by Howmet Turbine Components Corporation.

In a patent which issued on Nov. 14, 1978 (U.S. Pat. No. 4,125,417), a HIP process is disclosed for use in the same manner for the same purpose as stated above, except that it is applied for salvaging and restoring useful properties of used alloy parts containing such defects as grain boundary voids or dislocations induced by high temperature creep in service, in addition to such cast defects as micropores. Following HIP processing, the alloy part is then subjected to heat treatment (solution treatment and aging) to restore the mechanical properties to their original values.

The concept of employing the HIP process for upgrading the mechanical properties of magnesium and aluminum die castings is disclosed in U.S. Pat. No. 3,732,128, wherein the die casting is subjected to heat and pressure in a container at 300° C. to 600° C. under a pressure of 100 to 10,000 psi for 1 to 72 hours and rapidly cooled while still maintaining the applied pressure. The treated casting is thereafter aged at 100° C. to 250° C. for 1 to 72 hours at atmospheric pressure to improve the mechanical strength of the alloy.

Thus, it is known that the use of HIP processing, involving the simultaneous application of heat and high pressure to investment cast superalloys, results in significant improvements in high temperature mechanical properties which have made it possible for gas turbine designers to specify premium quality castings for critical industrial gas turbine applications. The motivation for using investment castings stems from an industry-wide effort to improve substantially the efficiency and cost effectiveness of gas turbines. In recent years, this effort has been further accentuated by worldwide inflation and a growing shortage of fossil fuel supplies.

It would be desirable to improve still further the capabilities of age-hardenable alloys, e.g., cast superalloys, in light of the ever-increasing high temperature demands being specified for jet engine components, such as for turbine blades employed in the hot end of the engine.

OBJECTS OF THE INVENTION

It is an object of the present invention to provide an improved HIP processing technique for further improving the mechanical properties of age-hardenable alloys of melting points in excess of 1000° C.

Another object is to provide the combination of a HIP process and heat treatment for markedly improving the stress-rupture properties of superalloys, such as age-hardenable iron-base, nickel-base, and cobalt-base alloys, as well as titanium-base alloys.

These and other objects will more clearly appear when taken in conjunction with the present disclosure and the following appended drawings.

THE DRAWINGS

STATEMENT OF THE INVENTION

Figure 1:
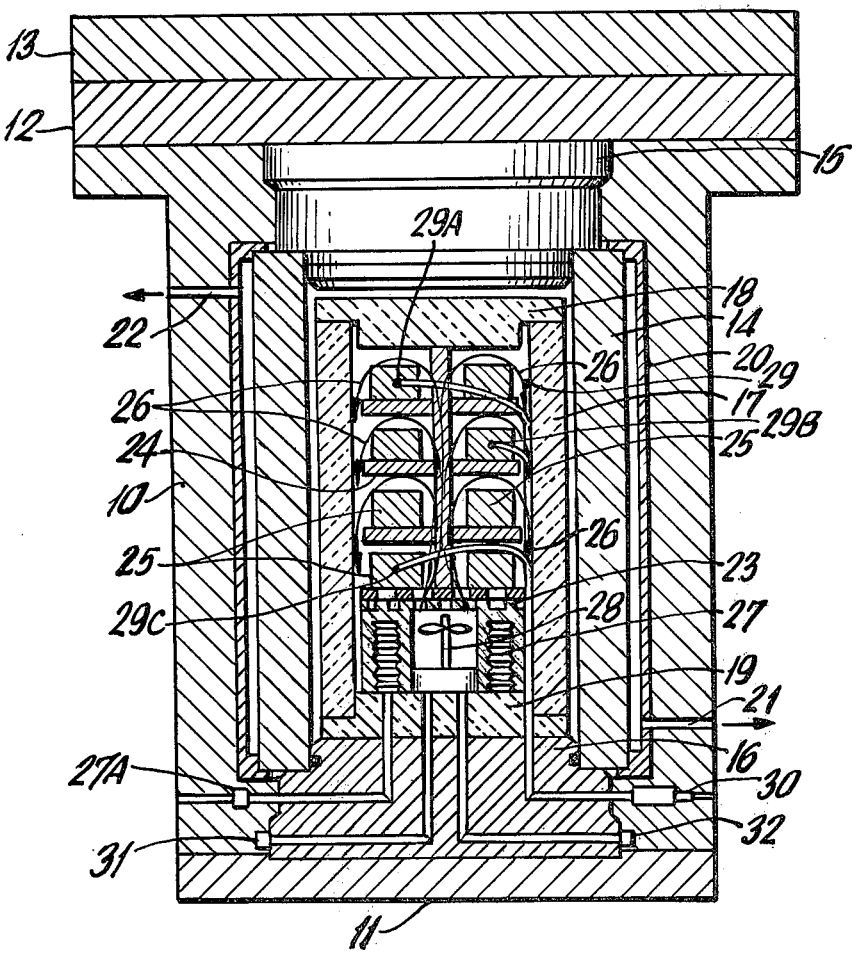
FIG. 1 is a schematic of a HIP unit which may be employed in carrying out the invention.

Stating it broadly, the invention is directed to a method of improving the mechanical properties of an age-hardenable alloy part characterized by the presence of such structural defects as cast micropores and/or grain boundary voids or microcracks, and the like, formed during high temperature service. The age-hardenable alloy is one having a melting point in excess of 1000° C., the method comprising, subjecting the alloy part to HIP processing in the autoclave at superatmospheric pressure and at an elevated solution temperature of the age-hardenable alloy in excess of 50% of the absolute melting point of the alloy for a time at least sufficient to effect substantial removal of said structural defects by heat and densification, and then heat treating the alloy part in situ by rapidly cooling it at a rate of over 20° C. per minute, and preferably at least about 25° C. per minute, for example, at least about 30° C. or higher per minute, to below the age-hardening temperature range of said alloy while maintaining said part under superatmospheric pressure, such that the part is improved in mechanical properties as compared to the same part conventionally heat treated by rapid cooling outside of said autoclave following HIP processing.

The term "structural defects" is meant to include defects of either unused aircraft parts (e.g., turbine blades in the cast form which have micropores inherent in certain investment casting techniques), or service-induced defects arising from the use of wrought or cast parts at elevated temperatures, including such defects as grain boundary voids or microcracks in which little or no dimensional changes have occurred during service; or the structural defects may comprise both those which exist initially as cast micropores together with defects developed in service due to creep; or the structural defects may comprise those which occur from high temperature cyclic loading during service, such as fatigue microcracks.

For example, the invention is applicable to the treatment of unused cast parts containing micropores wherein the micropores are substantially eliminated using the HIP process and the metallographic characteristics optimized from the heat treatment viewpoint by rapidly cooling the HIP treated part in situ under superatmospheric pressure before removing it from the autoclave. The same part after service in which defects have occurred due to creep or fatigue before substantial dimensional changes have occurred can also be treated according to the invention to further recover the degraded properties. Thus, the invention can be used on parts before use as well as on the same parts after use.

In many instances, a cast part having micropores can still meet specification requirements set for such parts for use, for example, as turbine blades and, therefore, may be put into service. Thus, when such parts during maintenance servicing are removed for reworking and for recovering the mechanical properties to substantially the original values by HIP processing, the parts will have both the original micropores and the additional defects that arise due to high temperature service. In this instance, regardless of source, substantially all of the defects can be removed by HIP processing and the part then rapidly cooled in situ to prepare the part for further heat treatment outside of the autoclave.

The foregoing method of the invention is applicable to a wide variety of wrought and cast age-hardenable alloys, to wit: age-hardenable iron-base alloys, nickel-base alloys, cobalt-base alloys, and titanium:base alloys.

As illustrative of the various alloys having melting points above 1000° C., the following examples are given:

(I) IRON-BASE ALLOYS

| Alloy Designation | % WEIGHT COMPOSITION | | | | | | | | |
|---|---|---|---|---|---|---|---|---|---|
| | C | Mn | Si | Cr | Ni | Mo | Ti | Al | B |
| Alloy 901 | .05 | .10 | .10 | 12.5 | 42.5 | 5.7 | 2.8 | 0.2 | 0.05 |
| A-286 | .05 | 1.35 | .50 | 15.0 | 26.0 | 1.3 | 2.0 | 0.2 | .015 |
| Discaloy | .04 | .90 | .80 | 13.5 | 26.0 | 2.7 | 1.7 | 0.1 | .005 |
| | IRON the balance. | | | | | | | | |

Included among the foregoing are the precipitation hardenable stainless steel grades having particular use as compressor blades in turbine engines, including discs and other turbine parts.

(II) NICKEL-BASE ALLOYS

| Alloy Designation | % WEIGHT COMPOSITION | | | | | | | | | | | | |
|---|---|---|---|---|---|---|---|---|---|---|---|---|---|
| | C | Mn | Si | Cr | Co | Mo | W | Nb | Fe | Ti | Al | B | Zr |
| Alloy 713C | 0.12 | — | — | 12.5 | — | 4.2 | — | 2.0 | — | 0.8 | 6.1 | 0.012 | 0.10 |
| B-1900* | 0.10 | — | — | 8.0 | 10.0 | 6.0 | — | — | — | 1.0 | 6.0 | 0.015 | 0.10 |
| D-979 | 0.05 | 0.25 | 0.20 | 15.0 | — | 4.0 | 4.0 | — | 27.0 | 3.0 | 1.0 | 0.010 | — |
| IN-738* | 0.15 | — | — | 16.0 | 8.5 | 1.7 | 2.6 | 0.9 | — | 3.4 | 3.4 | 0.01 | 1.0 |
| IN-792 Hf* | 0.12 | — | — | 12.4 | 9.0 | 1.9 | 3.8 | — | — | 4.5 | 3.1 | 0.01 | 0.1 |
| INCO 718 | 0.04 | 0.20 | 0.30 | 18.6 | — | 3.1 | — | 5.0 | 18.5 | 0.9 | 0.4 | — | — |
| IN-100* | 0.18 | — | — | 10.0 | 15.0 | 3.0 | — | — | — | 4.7 | 5.5 | 0.014 | 0.06 |
| MAR M200 | 0.15 | — | — | 9.0 | 10.0 | — | 12.5 | 1.0 | — | 2.0 | 5.0 | 0.015 | 0.05 |
| MAR M246* | 0.15 | — | — | 19.0 | 10.0 | 2.5 | 10.0 | — | — | 1.5 | 5.5 | 0.015 | 0.05 |

-continued

| Alloy Designation | (II) NICKEL-BASE ALLOYS % WEIGHT COMPOSITION | | | | | | | | | | | | |
|---|---|---|---|---|---|---|---|---|---|---|---|---|---|
| | C | Mn | Si | Cr | Co | Mo | W | Nb | Fe | Ti | Al | B | Zr |
| WASPALLOY | 0.07 | 0.5 max | 0.5 max | 19.5 | 13.5 | 4.3 | — | — | 2.0 max | 3.0 | 1.4 | 0.006 | 0.09 |
| René 41 | 0.09 | — | — | 19.0 | 11.0 | 10.0 | — | — | — | 3.1 | 1.5 | 0.005 | — |
| UDIMET 500 | 0.07 | — | — | 19.0 | 12.0 | 6.0 | 1.0 | — | — | 3.0 | 3.0 | 0.007 | 0.05 |
| | NICKEL the balance. | | | | | | | | | | | | |

*B-1900 also contains 4.0% Ta.
*IN-738 also contains 1.7% Ta.
*IN-792 Hf also contains 3.9% Ta and 0.2% Hf.
*IN-100 also contains 1.0% V.
MAR M246 also contains 1.5% Ta.

| Alloy Designation | (III) COBALT-BASE ALLOYS % WEIGHT COMPOSITION | | | | | | | | |
|---|---|---|---|---|---|---|---|---|---|
| | C | Mn | Si | Cr | Ni | Mo | W | Nb | Fe |
| S-816 | .38 | 1.20 | .40 | 20 | 20 | 4.0 | 4.0 | 4.0 | 4.0 |
| WI-52 | .45 | .25 | .25 | 21.0 | — | — | 11.0 | 2.0 | 2.0 |
| | COBALT the balance. | | | | | | | | |

The foregoing nickel-base and cobalt-base alloys may be used in turbine blades, turbine vanes, turbine discs and other turbine parts.

| Alloy Designation | (IV) TITANIUM-BASE ALLOYS % WEIGHT COMPOSITION | | | | | |
|---|---|---|---|---|---|---|
| | Al | Mo | V | Sn | Zr | Ti |
| Ti-6-4 | 6 | — | 4 | — | — | bal. |
| Ti-6-2-42 | 6 | 2 | — | 2 | 4 | bal. |
| Ti-6-2-4-6 | 6 | 6 | 4.0 | 2 | — | bal. |
| BETA III | — | 11.5 | — | 4.5 | — | bal. |
| Ti-8-1-1 | 8 | 1.0 | 1.0 | — | — | bal. |

The foregoing alloys may be used in compressor blades, discs, and other aircraft parts.

DETAILS OF THE INVENTION

In carrying the invention into practice, the HIP temperature employed in the autoclave for the various alloys (the homologous temperature) ranges from over 50% of the absolute melting point of the alloy to about 95% of the absolute melting point, e.g., about 60% to 95% of the absolute melting point, preferably from about 70% to 95% or 80% to 95% of the absolute melting point, so long as the temperature falls in the solutionizing temperature range of the alloy and preferably does not exceed the temperature at which incipient melting occurs. For the purposes of this invention, the homologous temperature referred to hereinabove as being over 50% of the absolute melting point of the alloy is that temperature at which mechanical strength of a metal becomes limited by creep rather than limited merely by yield strength.

Thus, in the case of iron-base, nickel-base, and cobalt-base superalloys, the HIP temperature may range from about 1800° F. (about 980° C.) to as high as 2350° F. (about 1290° C.) and the pressure from about 5,000 psig to 50,000 psig, the temperature and superatmospheric pressure selected being dependent upon the alloy being treated and the types of defects to be removed. The time of HIP treatment may range from about ½ hour to 16 hours, the time employed being substantially inversely related to the temperature and pressure selected for a particular alloy. Temperature is particularly important in assuring substantially complete removal of defects, such as micropores.

Following completion of the HIP treatment, the parts are rapidly cooled in situ at a cooling rate over 20° C. per minute, preferably at least about 30° C. per minute, e.g., about 30° to 50° C. or 60° C. per minute or higher.

FIG. 1 depicts schematically one form of equipment which may be used to HIP process the alloy components to be treated. Thus, referring to FIG. 1, an autoclave 10 is shown having a bottom 11 and cover plates 12, 13, the autoclave having enclosed within it a pressure vessel 14 with a pressure-resistant top cover 15 and a close-fitting bottom cover 16.

The vessel is provided with a furnace insulation mantle 17, a removable insulating furnace top 18, and an insulating furnace base 19. The vessel is surrounded by a cooling jacket 20 having a cooling water inlet 21 and a cooling water outlet 22.

Within the interior of the vessel is supported a perforated heat resistant pedestal 23 which serves as a base for work load rack 24 which contains the parts or workpieces 25 to be treated, the open rack configuration being such as to provide a controlled convection pattern 26 as shown during high temperature, high pressure processing and during rapid cooling.

The heat source comprises heating elements 27, such as graphite, disposed below the pedestal as shown, a forced convection blower 28 being provided to assure positive circulating flow of heated inert gas throughout the furnace and the rack. A fixed thermocouple 29 is employed, together with flexible thermocouples 29A, 29B, 29C, to provide a continuous reading of the temperature adjacent to the rack and the workpieces themselves, the thermocouple leadthrough being indicated by the numeral 30.

The power source for the heating elements is designated by the numeral 27A, while the source of inert gas pressure is indicated by the numeral 31 with a vacuum connection 32 for removing unwanted room air before pressurizing the autoclave.

In a particular cycle in the treatment of nickel-base superalloy components, the furnace is heated up to about 2400° F. (1315° C.) after the chamber is charged with an inert gas, such as argon or helium. Pressures as high as about 30,000 psig or higher may be reached from the combined effects of pumping and thermal expansion. Because the gas pressure is isostatic, the resulting product is substantially free of measurable distortion, provided that the internal structural defects are not of dimensions exceeding a significant fraction of the cross-sectional area.

As illustrative of the preferred embodiments of the invention, the following examples are given:

EXAMPLE 1

This example illustrates the importance of fast cooling of the alloy part within the autoclave while the isostatic pressure is maintained continuously on the part during the fast cooling period to below the age-hardening temperature for the alloy, which in this case is René 100 (0.18% C, 10.0% Cr, 15.0% Co, 3.0% Mo, 4.7% Ti, 5.5% Al, 0.014% B, 0.06% Zr, 1% V, and the balance nickel).

It should be noted here that superalloy turbine blades for the hot end of the engine are generally coated with a protective layer of metal by pack cementation, the coating metal being chromium and/or aluminum. The blades are generally coated at elevated temperatures in the range of 1300° F. (about 705° C.) to 2100° F. (about 1150° C.) for about 1 hour to 40 hours, for example, 1925° F. (1050° C.) for about 4 hours and slowly cooled. Such coating methods are disclosed in U.S. Pat. Nos. 3,257,230, 3,716,358, and 3,999,956.

In carrying out comparison tests within and outside the invention, samples of the same turbine blade component are hot isostatically pressed using substantially the same parameters as to temperature and pressure, except in one instance the part is rapidly cooled in the autoclave to below the age-hardening temperature from the hot isostatic pressing temperature, while in the other instance, the part is slowly cooled in the autoclave to below the age-hardening temperature as is done conventionally as follows:

(1) The invention

The René 100 alloy blades were subjected to HIP processing by heating the part in the autoclave at a temperature of 2175° F. (1190° C.) for 2 hours at about 28,000 psig, rapidly cooled within the autoclave to substantially below the age-hardening temperature range of the alloy at a rate of about 30° C. per minute. The parts were then removed from the autoclave and subjected to a thermal treatment corresponding to the temperatures, times, and cooling rates normally employed in pack cementation processes of the type referred to hereinbefore, the simulated thermal treatment being carried out at a temperature of 1925° F. (1025° C.) for 4 hours and then furnace cooled. The HIP temperature employed was approximately 93% of the absolute melting point of the alloy. Following the aforementioned thermal treatment, the parts were aged at 1550° F. (843° C.) for 4 hours and then air cooled.

As will be apparent, the particular post HIP thermal treatment employed on the blades includes in this instance the thermal heat treatment cycle inherent in the pack cementation process. However, the invention need not be so limited. That is to say, the post HIP thermal treatment may comprise simply a direct aging heat treatment outside of the autoclave or any other desirable heat treatment.

(2) Outside the Invention

Two separate treatments were conducted: (A) a conventional HIP process, and (B) heat treatment of the part without the HIP process.

(A) In the conventional HIP process, the parts were subjected to a temperature of 2175° F. (1190° C.) for 2 hours while under about 27,500 psig pressure followed by slow cooling at a rate less than 15° C. per min., the parts thereafter being heated in vacuum at 2175° F. (1190° C.) for 2 hours and vacuum cooled to 2000° F. (1093° C.) within 6 to 10 minutes and held at 2000° F. (1093° C.) for 4 hours under vacuum and then gas fan quenched. The parts were thereafter subjected to the thermal cycle normally employed for coating the blades as described hereinabove by subjecting the parts to a temperature of 1925° F. (1052° C.) for 4 hours and then furnace cooled, following which the parts were aged at 1550° F. (843° C.) for 4 hours and air cooled.

(B) In the heat treatment of the parts without employing the HIP process, the parts were first given the simulated thermal heat treatment cycle employed in the pack cementation process, that is, heated at 1925° F. (1052° C.) for 4 hours and then furnace or air cooled followed by aging at 1550° F. (843° C.) for 4 hours and then air cooled.

Following the foregoing treatments, the samples which were not given the HIP process and those which were treated with the conventional HIP process and the HIP process of the invention were prepared as test specimens and subjected to stress-rupture at 1400° F. (760° C.) at an applied load corresponding to 85KSI and a similar stress-rupture test at 1800° F. (982° C.) and a load corresponding to 29KSI.

The results obtained are given in the following tables:

TABLE 1

1400F-85KSI STRESS RUPTURE TESTS

| No. | HIP | Dia. (IN) | Life (HR) | El (%) | RA (%) |
|---|---|---|---|---|---|
| 1A | No HIP | .081 | 43.1 | 3.1 | 7.8 |
| 2A | " | .087 | 69.5 | 5.7 | 5.0 |
| 3A | " | .080 | 163.3 | 3.1 | 6.0 |
| 4A | " | .081 | 202.4 | 6.2 | 10.0 |
| 5A | " | .102 | 349.4 | 14.5 | 14.8 |
| Log Mean | | | 128.1 | 5.5 | 7.7 |
| 6A | Conventional HIP | .089 | 63.4 | 5.5 | 8.9 |
| 7A | Conventional HIP | .084 | 75.1 | 6.0 | 7.2 |
| 8A | Conventional HIP | .089 | 111.8 | 2.8 | 4.8 |
| 9A | Conventional HIP | .085 | 132.3 | 5.3 | 8.9 |
| 10A | Conventional HIP | .117 | 221.4 | 8.5 | 12.0 |
| 11A | Conventional HIP | .110 | 224.9 | 7.1 | 18.9 |
| 12A | Conventional HIP | .094 | 230.2 | 8.6 | 21.7 |
| 13A | Conventional HIP | .087 | 311.8 | 5.8 | 6.7 |
| 14A | Conventional HIP | .089 | 380.8 | 5.7 | 13.4 |
| 15A | Conventional HIP | .123 | 441.6 | 8.1 | 10.9 |
| Log Mean | | | 182.8 | 6.1 | 10.3 |
| 1 | HIP Process of Invention | .099 | 166.1 | 5.0 | 9.1 |
| 2 | HIP Process of Invention | .100 | 310.4 | 5.0 | 8.9 |
| 3 | HIP Process of Invention | .100 | 374.2 | 7.5 | 8.8 |
| 4 | HIP Process of Invention | .101 | 404.2 | 5.0 | 10.0 |
| 5 | Hip Process of Invention | .100 | 446.9 | 7.5 | 12.6 |
| Log Mean | | | 322.1 | 6.0 | 9.9 |

TABLE 2

1800F-29KSI STRESS RUPTURE TESTS

| No. | HIP | Dia. (IN) | Life (HR) | El (%) | RA (%) |
|---|---|---|---|---|---|
| 1B | No HIP | .089 | 22.8 | 11.1 | 12.9 |
| 2B | " | .089 | 27.8 | 8.3 | 12.6 |
| 3B | " | .089 | 29.0 | 5.5 | 6.4 |

TABLE 2-continued

| 1800F-29KSI STRESS RUPTURE TESTS | | | | | |
|---|---|---|---|---|---|
| No. | HIP | Dia. (IN) | Life (HR) | El (%) | RA (%) |
| Log Mean | | | 26.5 | 7.9 | 10.6 |
| 4B | Conventional HIP | .088 | 21.9 | 4.5 | 13.1 |
| 5B | Conventional HIP | .089 | 24.4 | 18.0 | 24.1 |
| 6B | Conventional HIP | .090 | 26.8 | 6.9 | 7.9 |
| 7B | Conventional HIP | .090 | 27.1 | 13.8 | 14.0 |
| 8B | Conventional HIP | .086 | 33.2 | 11.7 | 18.3 |
| 9B | Conventional HIP | .089 | 33.4 | 6.9 | 14.5 |
| 10B | Conventional HIP | .089 | 34.4 | 5.5 | 10.7 |
| 11B | Conventional HIP | .090 | 37.5 | 13.8 | 19.0 |
| Log Mean | | | 29.8 | 9.1 | 15.2 |
| 1 | HIP Process of Invention | .101 | 22.8 | 12.5 | 13.7 |
| 2 | HIP Process of Invention | .100 | 24.7 | 12.5 | 20.2 |
| 3 | HIP Process of Invention | .100 | 31.8 | 15.0 | 20.2 |
| 4 | Hip Process of Invention | .100 | 36.9 | 15.0 | 21.5 |
| 5 | HIP Process of Invention | .100 | 37.0 | 15.0 | 20.2 |
| Log Mean | | | 30.6 | 14.0 | 19.2 |

Figure 2:
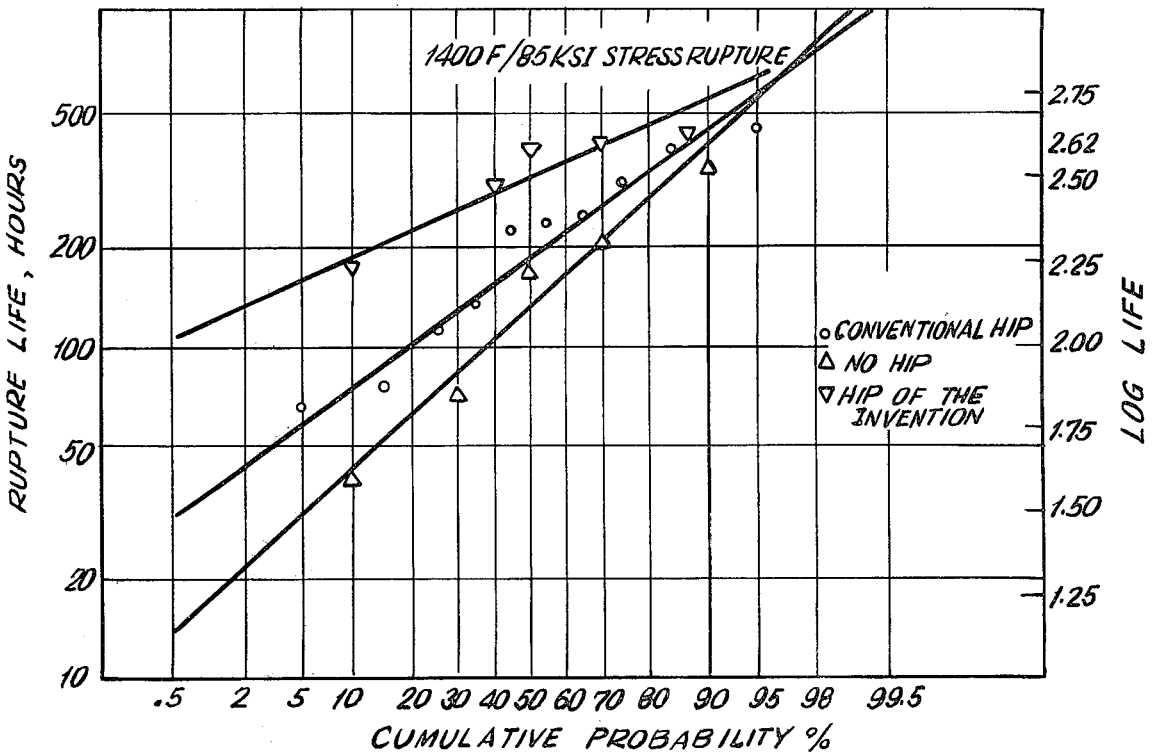
FIG. 2 is a graph comparing the rupture life in hours determined at a test temperature of 1400° F. under a load corresponding to 85KSI of a nickel-base superalloy (René 100) treated in accordance with the invention with the rupture life of the same alloy treated using the HIP process outside the invention.

As will be noted from Table 1, the HIP process of the invention indicated a surprising log mean average of stress-rupture life at 1400° F. and 85KSI of 322.1 as compared to 128.1 hours without the HIP process and 182.8 hours using the conventional HIP process. Note FIG. 2.

Figure 3:
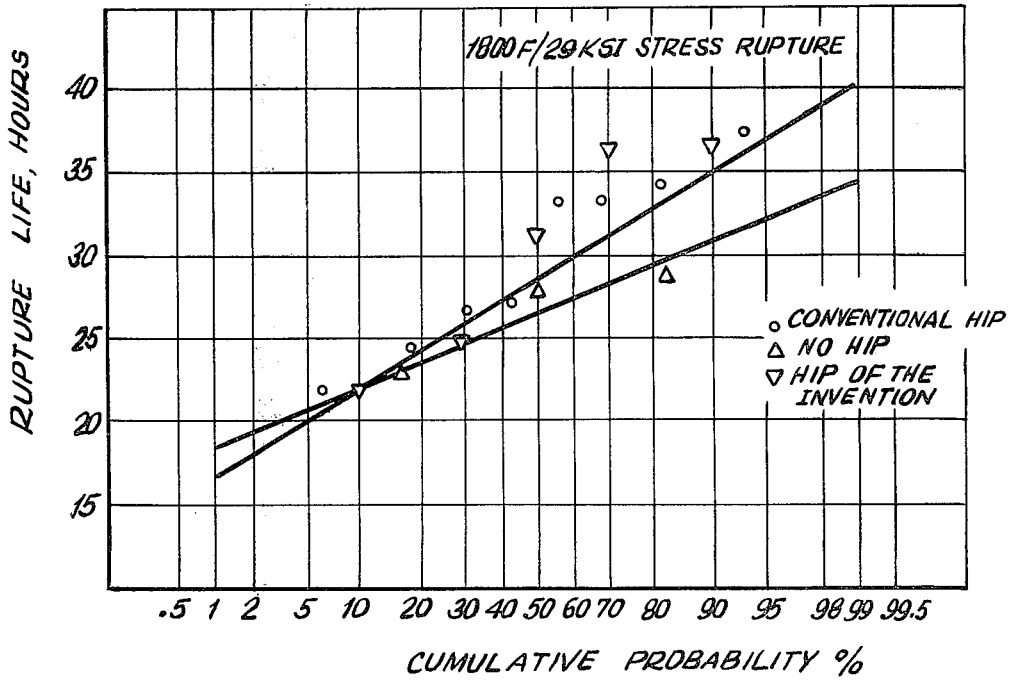
FIG. 3 is similar to FIG. 2 except that the rupture life is compared at 1800° F. under a load corresponding to 29KSI.

While the invention did not show a marked impact on the 1800° F. stress-rupture properties (note Table 2), the samples were not adversely affected and, if anything, showed a small improvement as will be evidenced by referring to FIG. 3.

EXAMPLE 2

Similar HIP testing was conducted on an alloy designated as SEL-15 which is an age-hardenable nickel-base alloy which contains by weight 0.08% C, 0.3% max. Mn, 0.5% max. Si, 10.5% Cr, 13.5% Co, 6.3% Mo, 1.5% W, 0.5% Nb, 2.5% Ti, 5.5% Al, 0.05% B, and the balance essentially nickel.

(1) The Invention

The alloy parts were subjected to HIP treatment at a temperature of 2175° F. (1190° C.) for 2 hours at about 29,000 psig (approximately 90% of the absolute melting point of the alloy), rapidly cooled within the autoclave to substantially below the age-hardening temperature range at a rate of about 30° C. per minute, the parts then removed from the autoclave and subjected to the simulated thermal heat treatment cycle employed in the pack cementation process, that is, heated at a temperature of 1925° F. (1052° C.) for 4 hours and then furnace cooled. Following the last treatment, the parts were aged at 1435° F. (780° C.) for 4 hours and air cooled.

(2) Outside the Invention

Two separate treatments were conducted: (A) a conventional HIP process, and (B) heat treatment of the parts without employing the HIP process.

(A) In the conventional HIP process, the parts were subjected to a temperature of 2175° F. (1190° C.) for 2 hours while under about 28,000 psig pressure at a rate less than 15° C., the parts thereafter being re-solutionized at 2175° F. (1190° C.) for 4 hours and vacuum cooled. The parts were thereafter subjected to the simulated thermal treatment corresponding to the thermal cycle employed in the pack cementation process, that is, at a temperature of 1925° F. (1052° C.) for 4 hours followed by furnace cooling, the parts thereafter being aged at 1435° F. (780° C.) for 4 hours and then air cooled.

(B) In the heat treatment of the parts without employing the HIP process, the parts were first given the simulated thermal treatment at 1925° F. (1025° C.) for 4 hours and then furnace cooled followed by aging at 1435° F. (780° C.) for 4 hours and then air cooled.

The parts treated as above were prepared for creep testing (0.1 inch diameter) and were tested at 1400° F. (760° C.) at an applied load corresponding to 85KSI.

Figure 4:
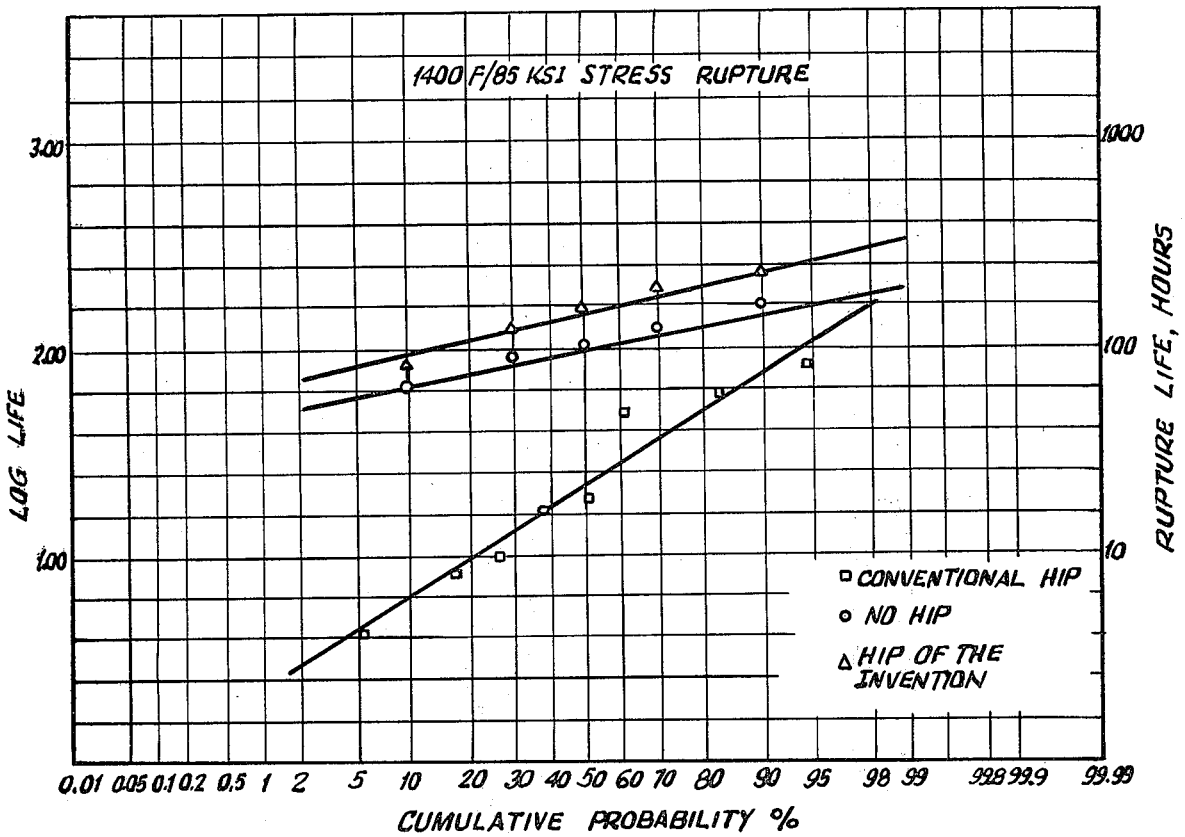
FIG. 4 is similar to FIG. 2 except that the material is a nickel-base alloy designated as SEL-15.

The results obtained are given in Table 3 below and in FIG. 4.

TABLE 3

| 1400° F.-85KSI STRESS RUPTURE TESTS | | |
|---|---|---|
| Test No. | Life (HR) | % EL |
| NO HIP | | |
| 1C | 91.8 | 3.7 |
| 2C | 170.6 | 3.7 |
| 3C | 132.6 | 3.7 |
| 4C | 104.8 | 5.0 |
| 5C | 64.5 | 3.7 |
| Log Mean | 107.1 | 3.9 |
| 98% Limit | 50.1 | 3.0 |
| CONVENTIONAL HIP | | |
| 6C | 64.3 | 2.6 |
| 7C | 8.8 | 5.5 |
| 8C | 4.5 | 10.8 |
| 9C | 17.0 | 3.3 |
| 10C | 52.6 | 3.4 |
| 11C | 10.3 | 8.3 |
| 12C | 19.9 | 6.6 |
| 13C | 88.8 | 6.2 |
| 14C | 51.2 | 7.5 |
| Log Mean | 23.4 | 5.5 |
| 98% Limit | 3.1 | 2.6 |
| HIP PROCESS OF INVENTION | | |
| 6 | 200.9 | 10.0 |
| 7 | 141.1 | 6.2 |
| 8 | 89.3 | 7.5 |
| 9 | 158.4 | 8.7 |
| 10 | 237.1 | 18.0 |
| Log Mean | 156.9 | 9.4 |
| 98% Limit | 74.1 | 4.2 |

As will be noted, the HIP process of the invention exhibited a surprisingly high log mean average of stress-rupture life of 156.9 hours as compared to 23.4 hours for conventional HIP and 107 hours for no HIP, the method of the invention showing a confidence limit or rating at 98% of 74.1 hours as compared to 3.1 hours for convention HIP and 50.1 hours for no HIP. In this example, the high temperature properties of the SEL-15 blade were not improved by the conventional HIP treatment and the post HIP heat treatment cycle when compared with the SEL-15 blades given a thermal cycle normally employed in the pack cementation process followed by an aging heat treatment. However, this was not the case with Example 1.

Thus, a major advantage of this invention is that it consistently enables the achievement of markedly improved or fully recovered high temperature mechanical properties of a broad range of superalloy compositions;

whereas, that is not generally the case with conventional HIP processing. This distinction will be apparent by referring to Example 2 (note FIG. 4) which shows that with respect to alloy SEL-15, the no HIP condition appears to be superior to the conventional HIP and heat treated condition; whereas, in Example 1 (note FIG. 2), the conventional HIP process is superior to the process where no HIP is employed. Nevertheless, in both examples, the HIP process of the invention achieved markedly higher mechanical properties than did the conventional HIP process.

A still further advantage provided by the invention is that the process enables the use of more simplified post HIP heat treatments, which is generally not the case when employing conventional HIP processing techniques.

EXAMPLE 3

As stated herein, the invention is applicable to iron-base alloy parts, for example, an alloy known by the designation A-286 which has a nominal composition of 0.05% C, 1.35% Mn, 0.50% Si, 15.0% Cr, 26.0% Ni, 1.3% Mo, 2% Ti, 0.2% Al, 0.015% B, and the balance iron. This alloy has a melting range of about 2500°–2550° F. or an average melting point of about 2525° F. (1385° C.). The HIP process temperature selected is about 75% of the absolute melting point of the alloy which is 1658° K. The HIP temperature calculates to about 970° C. or approximately 1780° F., this being approximately the solution temperature of the alloy.

The iron-base alloy part is subjected to hot pressing at 1780° F. for 4 hours at about 25,000 psig and then rapidly cooled at a rate of over 30° C. per minute to below the aging temperature of said alloy. Following the HIP treatment, the alloy is then aged at 1325° F. (about 720° C.) for 16 hours and then air cooled.

Similar results are obtainable with other age-hardenable alloys, such as a titanium-base alloy referred to as Ti-6-2-4-6. An example for treating this alloy is given as follows:

EXAMPLE 4

A titanium casting of the aforementioned composition tends to exhibit shrinkage cavities, i.e., micropores, but nevertheless may demonstrate a level of radiographic quality acceptable for many low stress structural parts. The titanium-base alloy, which contains 6% Al, 2% Sn, 4% Zr, 6Mo, and the balance essentially titanium, has a liquidus temperature of 3000° F. (1649° C.). The foregoing melting point corresponds to an absolute melting point of about 1922° K. A HIP temperature is selected corresponding to about 62% of the absolute melting point of the alloy, which calculates to about 920° C. or about 1690° F. Thus, the titanium-base alloy part is hot isostatically pressed at about 1690° F. (920° C.) and about 28,000 psig for about 4 hours and then rapidly cooled in situ at a cooling rate of about 30° to 40° C. per minute while under superatmospheric pressure to below the age-hardening temperature range.

Following the foregoing treatment, the alloy is then aged at 1100° F. (593° C.) for about 8 hours and air cooled to achieve the desired mechanical properties.

As stated herein, the invention is particularly applicable to the treatment of superalloys of the age-hardenable nickel-base and cobalt-base variety. A typical alloy composition range is one containing by weight of up to about 30% Cr, e.g., about 5% to 30% Cr, up to about 20% of a metal from the group consisting of Mo and W, up to about 10% of a metal from the group consisting of Cb and Ta, up to about 1% C (preferably up to about 0.5%), up to about 10% of a metal from the group consisting of Ti and Al, e.g., about 0.2% to 10%, the total amount of Ti and Al not exceeding about 12%, up to about 20% Fe, up to about 2% Mn, up to about 2% Si, up to about 0.2% B, up to about 1% Zr, up to about 2% Hf, and the balance at least about 45% by weight of at least one metal selected from the group consisting of nickel and cobalt.

The expression "balance at least about 45% by weight of at least one of the metals nickel and cobalt" means that when the two metals are present, the sum is at least about 45% of the total composition. Thus, nickel may be present alone, or cobalt may be present alone, each in the amount of at least about 45%. When both are present, either may be present over any range in making up the balance so long as the sum of the two is at least about 45% by weight.

Alloys of the foregoing type are generally heat treated by subjecting them to a solution temperature of about 1080° C. to 1125° C. (1975° F. to 2050° F.) for from about ½ hour to 16 hours and furnace or air cooled. Following the solution treatment, the alloy may be precipitation hardened (age hardened), for example, by aging at a temperature in the range of about 730° C. (1350° F.) to 870° C. (1600° F.) for upwards of 24 hours, e.g., 4 to 10 hours.

Although the present invention has been described in conjunction with preferred embodiments, it is to be understood that modifications and variations thereto may be resorted to without departing from the spirit and scope of the invention as those skilled in the art will readily understand. Such modifications and variations are considered to be without the purview and scope of the invention and the appended claims.

What is claimed is:

1. A method of improving the mechanical properties of an age-hardenable alloy part characterized by the presence of such structural defects as cast micropores and/or grain boundary voids or microcracks formed during high temperature service, said alloy having a melting point of at least about 1000° C. which comprises, subjecting said age-hardenable alloy part to HIP processing in an autoclave at superatmospheric pressure and at an elevated solution temperature of said age-hardenable alloy in excess of 50% of the absolute melting point of said alloy for a time at least sufficient to effect substantial removal of said structural defects by heat and densification, heat treating said alloy part in situ by rapidly cooling it at a rate of over 20° C. per minute to below the age-hardening temperature range of said alloy while maintaining said part under superatmospheric isostatic pressure, and then age-hardening said alloy following completion of said HIP processing, whereby said part is improved in mechanical properties as compared to the same part heat treated by rapid cooling said alloy part outside of said autoclave and aging it following conventional HIP processing.

2. The method of claim 1, wherein the age-hardenable alloy is selected from the group consisting of iron-base, nickel-base, cobalt-base, and titanium-base alloys, wherein the hot isostatic pressure ranges from about 5,000 to 50,000 psig and wherein the hot isostatic pressing temperature ranges from about 60% to 95% of the absolute melting point of the alloy.

3. The method of claim 2, wherein the rapid cooling rate in the autoclave is at least about 25° C. per minute.

4. The method of claim 3, wherein the alloy part is a superalloy part.

5. The method of claim 4, wherein said superalloy is a nickel-base alloy and wherein the hot isostatic pressing temperature ranges from about 70% to 95% of the absolute melting point of the alloy.

6. The method of claim 5, wherein the hot isostatic pressing temperature ranges from about 80% to 95% of the absolute melting point of the alloy.

7. A method of improving the mechanical properties of an age-hardened alloy part selected from the group consisting of iron-base, nickel-base, cobalt-base, and titanium-base alloys of melting point in excess of 1000° C. characterized by the presence of such structural defects as cast micropores and/or grain boundary voids or microcracks formed during high temperature service which comprises, subjecting said alloy part to HIP processing in an autoclave at superatmospheric pressure and at an elevated solution temperature of said age-hardened alloy ranging from over 50% to about 95% of the absolute melting point of said alloy for a time at least sufficient to effect substantial removal of said structural defects by heat and densification, heat treating said alloy part in situ by rapidly cooling it at a rate of at least about 25° C. per minute to below the age-hardening temperature range of said alloy while maintaining said part under superatmospheric isostatic pressure, and then age-hardening said alloy following completion of said HIP processing, whereby said part is improved in mechanical properties as compared to the same part treated by rapid cooling said alloy part outside of said autoclave and aging it following conventional HIP processing.

8. The method of claim 7, wherein the hot isostatic temperature ranges from about 60% to 95% of the absolute melting point, and wherein the hot isostatic pressure ranges from about 5,000 to 50,000 psig.

9. The method of claim 8, wherein said alloy part is a superalloy part.

10. The method of claim 9, wherein the superalloy part is a nickel-base alloy and wherein the hot isostatic temperature ranges from about 70% to 95% of the absolute melting point.

11. A method of improving the mechanical properties of an age-hardenable superalloy part characterized by the presence of such structural defects as cast micropores and/or grain boundary voids or microcracks formed during high temperature service, said alloy having a melting point of at least about 1000° C. which comprises, providing at least one part of composition containing by weight up to about 30% Cr, up to about 20% of a metal from the group consisting of Mo and W, up to about 10% of a metal from the group consisting of Cb and Ta, up to about 1% C, up to about 10% of a metal from the group consisting of Ti and Al, the total amount of Ti and Al not exceeding about 12%, up to about 20% Fe, up to about 2% Mn, up to about 2% Si, up to about 0.2% B, up to about 1% Zr, up to about 2% Hf, and essentially the balance at least about 45% by weight of at least one metal selected from the group consisting of nickel and cobalt, subjecting said age-hardenable alloy part to HIP processing in an autoclave at superatmospheric pressure and at an elevated solution temperature of said age-hardenable alloy in excess of 50% of the absolute melting point of said alloy for a time at least sufficient to effect substantial removal of said structural defects by heat and densification, heat treating said alloy part in situ by rapidly cooling it at a rate of over 20° C. per minute to below the age-hardening temperature range of said alloy while maintaining said part under superatmospheric isostatic pressure, and then age-hardening said alloy following completion of said HIP processing, whereby said part is improved in mechanical properties as compared to the same part heat treated by rapid cooling said alloy part outside of said autoclave and aging it following conventional HIP processing.

12. The method of claim 11, wherein the hot isostatic pressure ranges from about 5,000 to 50,000 psig and wherein the hot isostatic pressing temperature ranges from about 70% to 95% of the absolute melting point of the alloy.

13. The method of claim 12, wherein the rapid cooling rate in the autoclave is at least about 25° C. per minute.

14. The method of claim 13, wherein the alloy is a nickel-base alloy and wherein the hot isostatic temperature ranges from about 80% to 95% of the absolute melting point of the alloy.

* * * * *